United States Patent [19]

Bayles et al.

[11] Patent Number: 4,990,745

[45] Date of Patent: Feb. 5, 1991

[54] STEAM GENERATORS

[75] Inventors: Peter W. Bayles, Newton Ayclisse; Philip Million, Howden-le-Wear, both of England

[73] Assignee: Black & Decker Inc., Newark, Del.

[21] Appl. No.: 365,936

[22] Filed: Jun. 13, 1989

[30] Foreign Application Priority Data

Jun. 15, 1988 [GB] United Kingdom ..... 8814206

[51] Int. Cl.[5] ..... F22B 1/28

[52] U.S. Cl. ..... 392/386; 392/399

[58] Field of Search ..... 219/271–276, 219/299, 302, 305; 38/77.82, 77.83, 77.9

[56] References Cited

U.S. PATENT DOCUMENTS

| | | | |
|---|---|---|---|
| 2,059,620 | 11/1936 | Abrams | 219/275 |
| 2,285,757 | 6/1942 | Smith | 38/77.9 |
| 2,637,126 | 4/1953 | Fitzsimmons | 38/77.9 |
| 2,793,448 | 5/1957 | Duncanson | 38/77.83 |
| 3,304,636 | 2/1967 | Vieceli | 38/77.9 |
| 3,599,357 | 8/1971 | Gronwick | 38/77.5 |
| 3,711,972 | 1/1973 | Risacher | 38/77.83 |
| 3,811,208 | 5/1974 | Vieceli et al. | 38/72.8 |
| 3,820,259 | 6/1974 | Flowers | 38/77.5 |
| 4,077,143 | 3/1978 | Walker | 38/77.83 |
| 4,091,551 | 5/1978 | Schaeffer | 38/77.83 |
| 4,495,932 | 1/1985 | Bratton | 126/20 |
| 4,546,697 | 10/1985 | Schaeffer | 99/279 |
| 4,833,298 | 5/1989 | Wilkins | 219/273 |
| 4,835,364 | 5/1989 | Wilkins | 219/273 |
| 4,843,215 | 6/1989 | Wilkins | 219/271 |
| 4,851,642 | 7/1989 | Wilkins | 219/275 |
| 4,855,568 | 8/1989 | Wilkins | 219/271 |
| 4,857,703 | 8/1989 | Wilkins | 219/271 |

FOREIGN PATENT DOCUMENTS

| | | |
|---|---|---|
| 0117852 | 2/1984 | European Pat. Off. . |
| 0136826 | 8/1984 | European Pat. Off. . |
| 0159134 | 3/1985 | European Pat. Off. . |
| 0268478 | 11/1987 | European Pat. Off. . |
| 517091 | 1/1931 | Fed. Rep. of Germany . |
| 3545753 | 6/1987 | Fed. Rep. of Germany . |
| 655509 | 8/1948 | United Kingdom . |
| 804714 | 6/1955 | United Kingdom . |
| 785178 | 2/1956 | United Kingdom . |
| 1045767 | 5/1964 | United Kingdom . |
| 1071036 | 9/1964 | United Kingdom . |
| 1332950 | 7/1971 | United Kingdom . |
| 1444657 | 5/1974 | United Kingdom . |
| 2002423 | 7/1978 | United Kingdom . |
| 2073256 | 2/1981 | United Kingdom . |
| 2067600 | 7/1981 | United Kingdom . |

*Primary Examiner*—Teresa J. Walberg

*Attorney, Agent, or Firm*—Dennis A. Dearing; Charles E. Yocum; Edward D. C. Bartlett

[57] ABSTRACT

A steam generator for a wallpaper stripper includes a member of heat conductive metal in which is cast an electrical heating element of generally W-shape. Water is supplied to an inlet chamber in the member. Leading from the chamber to spaced steam outlets in the member is a series of extended passageways formed by channels between adjacent limbs of the element and ribs that extend both along and across the channels. The nozzles are located in walls.

30 Claims, 8 Drawing Sheets

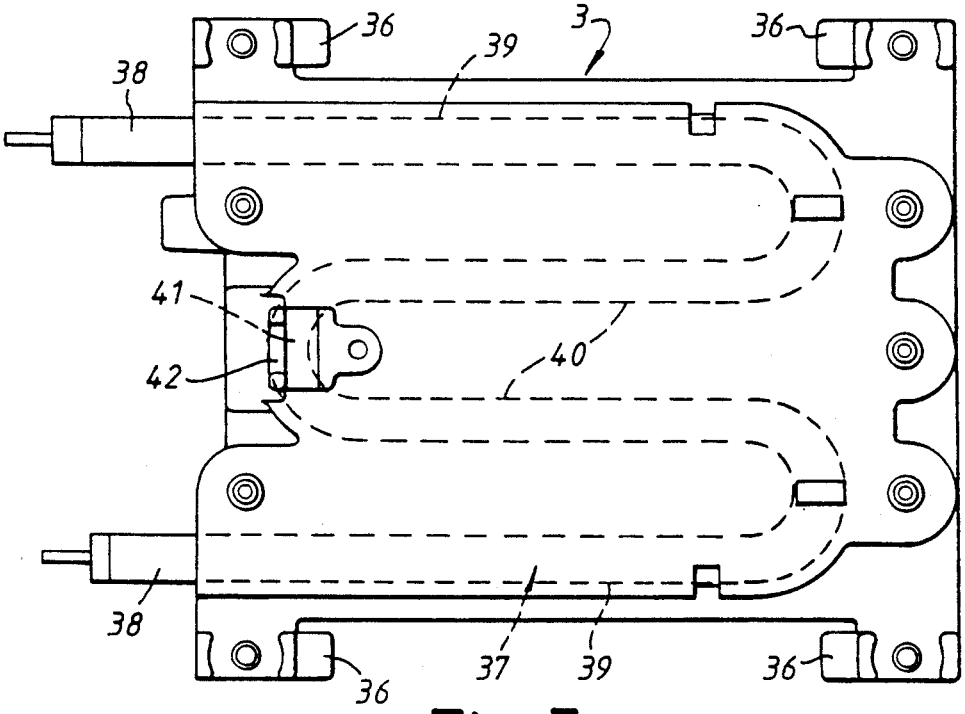
Fig. 7
Fig. 8
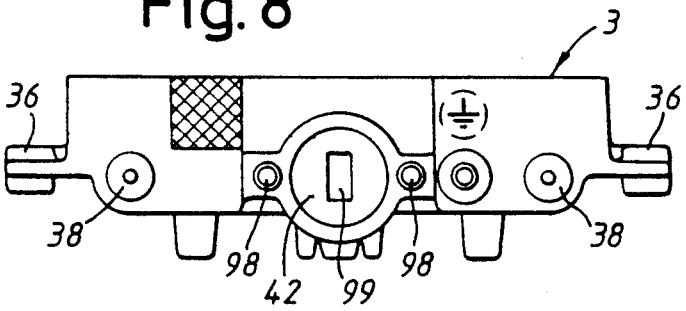

STEAM GENERATORS

FIELD OF THE INVENTION

This invention relates to steam generators especially steam generators for use in hand-held tools for example wallpaper strippers and crease removers.

BACKGROUND OF THE INVENTION

Tools such as those just mentioned must be capable of effective use in a number of different orientations and with some prior proposals it is found that in certain orientations hot water is ejected from the steam nozzles of the tool. This reduces the effectiveness of the tool and may be dangerous to the user. It is also found that in prior proposals there is a tendency for chalk particles to form in the steam passageways and to pass to the steam nozzles where the particles may block the nozzles and again this reduces the effectiveness of the tool.

SUMMARY OF THE INVENTION

It is an object of the present invention to provide a steam generator in which the problems referred to above are largely overcome.

According to the present invention, a steam generator comprises a heat conductive member with anintegral heater and formed to provide an inlet chamber from which extend a series of extended passageways bounded, at least in part, by lateral and transverse barriers, the passageways extending from the inlet chamber to each of a series of steam outlets in the generator and in which some at least of the barriers are gapped.

Alternatively, the steam generator may comprise a body of heat conductive material with an electric heating element housed within the body, the element having a series of spaced, parallel, co-planar limbs adjacent ones of which are channels, there being a series of spaced barriers across the channels and lateral barriers alongside some of the channels, the barriers being so arranged as to provide a series of extended passageways leading from an inlet chamber in the body to each of a series of steam outlets in the body.

Yet again, the steam generator may comprise a body of heat conductive material with an electric heating element housed within the body, the body having an inlet chamber and extending therefrom a series of extended passageways leading from the inlet chamber to each of a series of spaced steam outlets in the generator, each steam outlet being located within a well in the body.

In another form, the steam generator comprises a body of heat conductive material, an electric heating element housed within the body, the element having a series of spaced, parallel co-planar limbs, the limbs being enclosed within the material in a manner such that channels are formed between adjacent limbs, a water inlet chamber formed in the body close to one end of an adjacent pair of limbs, a series of spaced steam outlets formed in the body and interconnected with the inlet chamber by extended passageways which include the channels.

In a further form, the steam generator comprises a body of heat conductive material of rectangular form when seen in plan, an electrical heating element housed within the body, the element having a series of spaced, parallel co-planar limbs which lie parallel to the sides of the body and are spaced across the body, the ends of the element projecting from one end of the body, adjacent limbs within the body being interconnected by curved portions, the limbs and the curved portions being enclosed within the material in a manner such that channels are formed between adjacent limbs, a water inlet chamber formed in the body centrally of the sides thereof and adjacent the curved portions interconnecting immediately adjacent limbs, a series of barriers spaced along the lengths of the limbs and extending transversely thereof, and further lateral barriers lying parallel to the sides of the body, the barriers providing, with the channels, extended passageways leading from the inlet chamber to each of a series of steam outlet nozzles in the body, each nozzle being located within a well formed in the body.

In any of the forms of steam generator just referred to, there may be transverse barriers some of which are gapped to allow communication between passageways on each side of the barriers.

The integral heater may be an electric heater having a series of spaced, parallel, co-planar limbs between adjacent ones of which are channels that form parts of the extended passageways.

The steam generator may have a water inlet chamber defined in part by a transverse barrier of curved shape when seen in plan.

The steam generator may have steam outlets arranged in two groups of which one group is located adjacent one end of the body, the other group being located adjacent the other end of the body.

There may be a first lateral barrier lying adjacent each respective side of the body and spaced therefrom to define lateral passageways leading to the steam outlets at both ends of the body.

The lateral passageways may communicate, in an area adjacent the other end of the body, with a channel lying centrally of the sides of the body.

There may be further lateral barriers lying adjacent respective ones of the first barriers to form further lateral passageways extending from the inlet chamber.

The invention also comprises a hand-held wallpaper steamer including a steamer generator of one or other of the forms defined above.

BRIEF DESCRIPTION OF THE DRAWING

A hand-held wallpaper steamer including a steam generator embodying the invention will now be described in greater detail with reference to the accompanying drawings of which:

FIG. 7 is an underneath view of the steam generator shown in FIG. 5, FIG. 8 and 9 are, respectively, views of opposite ends of the steam generator shown in FIG. 5.

DETAILED DESCRIPTION OF THE PREFERRED EMBODIMENTS

Figure 1:
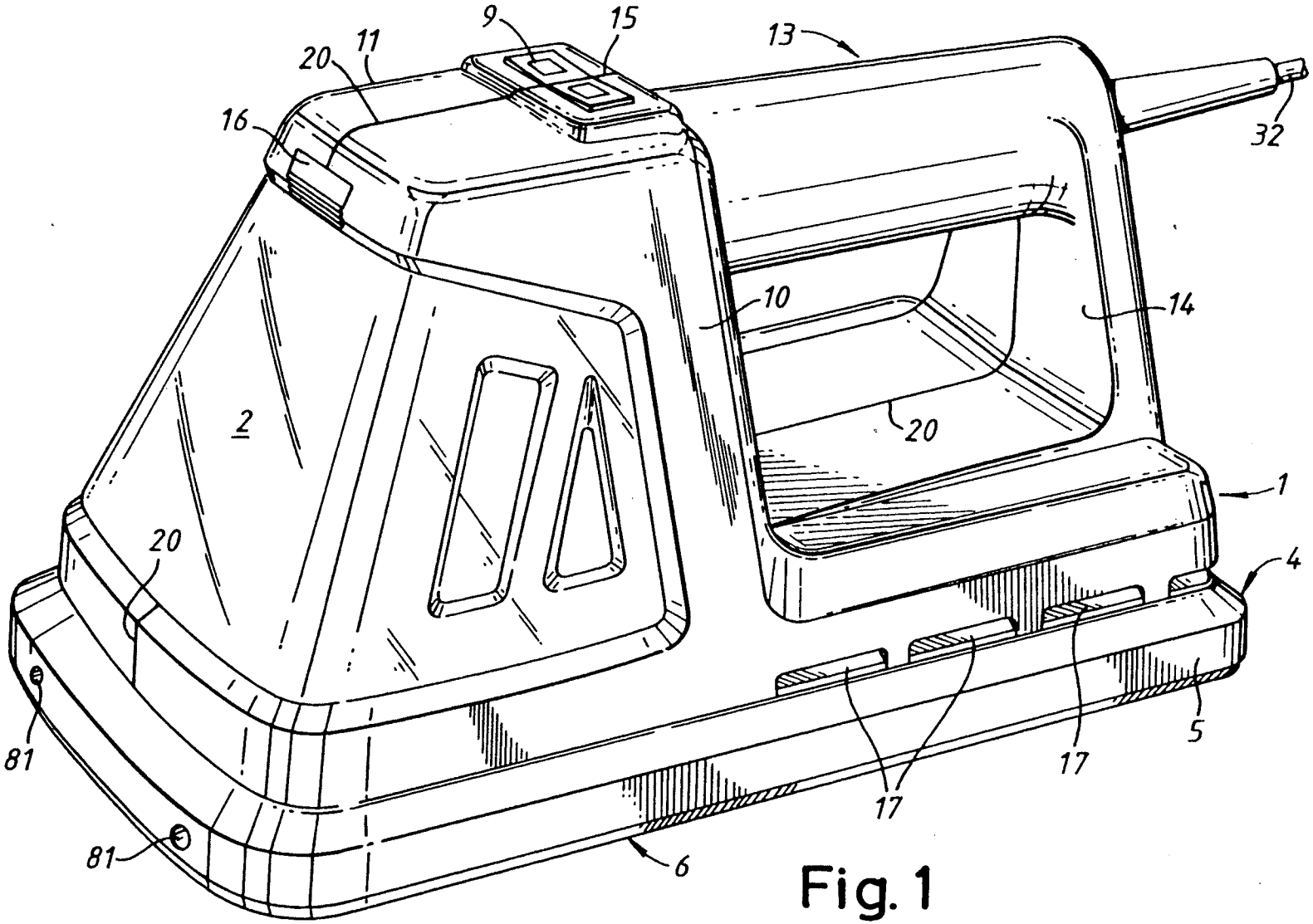
FIG. 1 is a perspective view of the steamer.

The wallpaper steamer is generally of the form and construction described in European Patent Application No. 0 268 478 (87.310216.4), the contents of which are incorporated hereinto by reference.

The steamer is used to steam wallpaper prior to stripping the paper with a conventional stripping knife. However, the steamer may also be used when stripping other surface coverings secured to the surface by heat and/or moisture softenable adhesives.

As can be seen from FIGS. 2 and 3, the steamer includes a housing 1 contoured to accommodate a detachable water tank 2, an electrically-heated steam generator 3 and a base portion 4 with a peripheral wall 5, thereby forming a downwardly-open (as viewed in FIGS. 1, 2 and 3) chamber 6, hereinafter referred to as a steam chamber. Water from water tank 2 is pumped into a water chamber in the steam generator 3 by an electrically-powered pump shown diagrammatically at 7. Energisation of pump 7 is controlled by an electric switch 8 operated by a rocker arm 9. Steam from the steam generator 3 leaves the latter via exit holes in its lower face and emerges into the steam chamber via connectors described below.

The housing 1 includes a central portion 10 which extends away from the base portion 4 and has a forward projection 11 beneath which the water tank 2 is located on a flat part 12 of the housing 1. Extending rearwardly from the uppermost part of portion 10 is a handle 13 of generally cylindrical shape and which terminates in a flat end 14 of triangular shape and which is part of the housing 1 thereby forming a handle of a closed loop configuration. The cross-sectional size of the handle 13 in a plane transverse to its length is much smaller than that rear face of portion 10 from which the handle 13 extends and can readily be gripped by a user.

Figure 2:
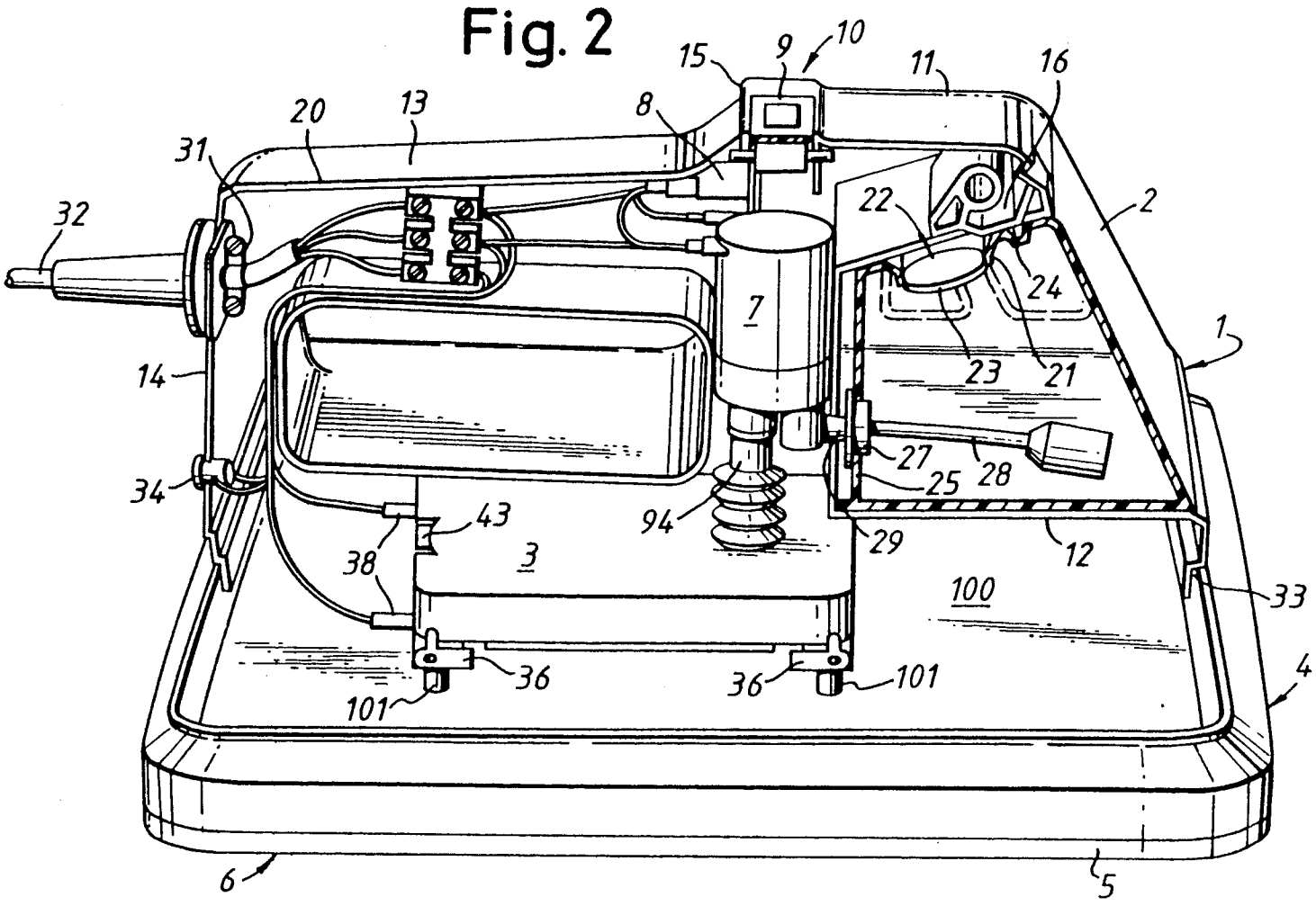
FIG. 2 is a perspective view of the steamer, parts of an external wall having been removed to reveal internal components shown in diagrammatic form.
Figure 3:
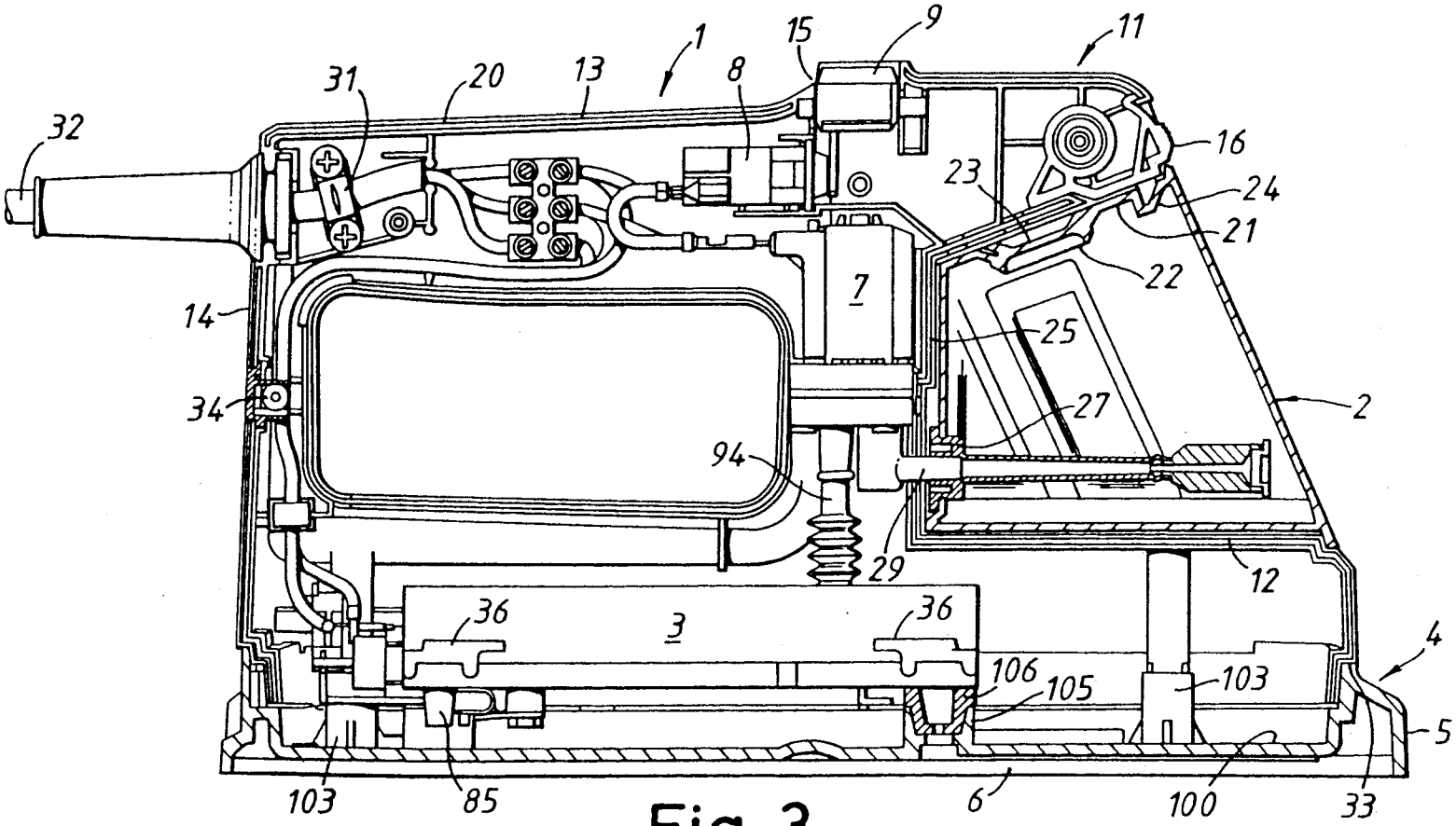
FIG. 3 is a part sectional side view of the steamer.

As can be seen, the upper surface (as seen in FIGS. 1 and 2) of projection 11 is contoured as at 15 to accommodate the rocker arm 9 that operates the switch 8.

Located in the forward projection 11 of the housing 1 is a pivotally mounted catch 16 for retaining the water tank 2 in the position in which it is shown in FIGS. 1 and 2. Catch 16 can be actuated by a user to release the water tank 2 prior to detaching the tank from the, housing. The catch 16 is so contoured that it is displaced by the tank 2 on initial movement of the latter towards the position shown in FIGS. 1 and 2. On final movement of the tank 2 into that position, the catch 16 automatically returns to a tank retaining position.

The housing 1 has, on both sides, air holes !7 which allow air to circulate within it so limiting heat transfer from the steam generator 3 to the housing 1.

The water tank 2 is of generally cubic form but is contoured to blend in with the contours of the housing 1 when in position thereon. The upper wall 21 of the water tank 2 has a filler hole 22 normally closed by a removably stopper 23. The upper wall 21 also has a rectangular recess 24 which co-operates with catch 16 to retain the water tank in position on the housing 1.

The inner wall 25 of the tank 2 accommodates a connector 27 forming part of a water inlet tube 28 inside the water tank 2. The inlet end of the tube 28 is weighted as indicated at 28*a* to ensure that the inlet end always remains below the water level in the tank 2. The connector 27 automatically engages with a short nozzle 29 of pump 7 in the portion 10 of the housing 1 as the water tank 2 reaches its fully home position on the housing.

The housing 1 is of clam shell construction and is formed by two clam shells which abut along a vertical fore and aft plane through the middle of the steamer. The junction line between the clam shells is indicated at 20 in FIG. 2.

The clam shells are moulded from a suitable plastics material for example talc filled polypropylene and are contoured on one face—the inner face—to support and/or locate the components mounted inside the housing formed when the clam shells are placed together.

The clam shells are generally similar as regards their external faces, each providing one half of the following parts of the housing 1—central portion 10, the forward projection 11, the flat part 12, the handle 13 and the flat end 14.

The clam shells are contoured in such manner that, when placed together in mating relationship, they provide a generally "wedge" shaped housing 1 when seen from the front or rear, i.e. the gradual inwardly tapering from the lower and widest part to the upper and narrowest part.

One of the clam shells has a groove (not shown) round the major part of its periphery which mates with a corresponding projection round the periphery of the other clam shell. The inner faces of the clam shells have projecting ribs, some of which support switch 8 and rocker arm 9, semi-circular recesses in those ribs providing bearing surfaces for the rocker arm 9.

Further ribs on both clam shells together define the location of the steam generator 3 and of the pump 7.

Within the handle portion 13 is a cable entry adjacent which is a moulding for the reception of a jaw and which, together with the moulding, forms a cable clamp 31 for a power cable 32.

Round its lower edge, the clam shells are stepped to receive a corresponding stepped edge of the base portion 4 as indicated at 33.

The rear face of the downturn 14 is formed with a semi-circular recess to receive a neon indicating lamp 34.

The clam shells are secured together by screws which pass through apertures in one clam shell and into bosses in the other clam shell.

The steam generator 3 is electrically heated, power to the heater being supplied via the power cable 32, energisation of the heater being indicated by neon indicator 34.

The steam generator will now be described in more detail with reference to FIGS. 3–11.

Figure 5:
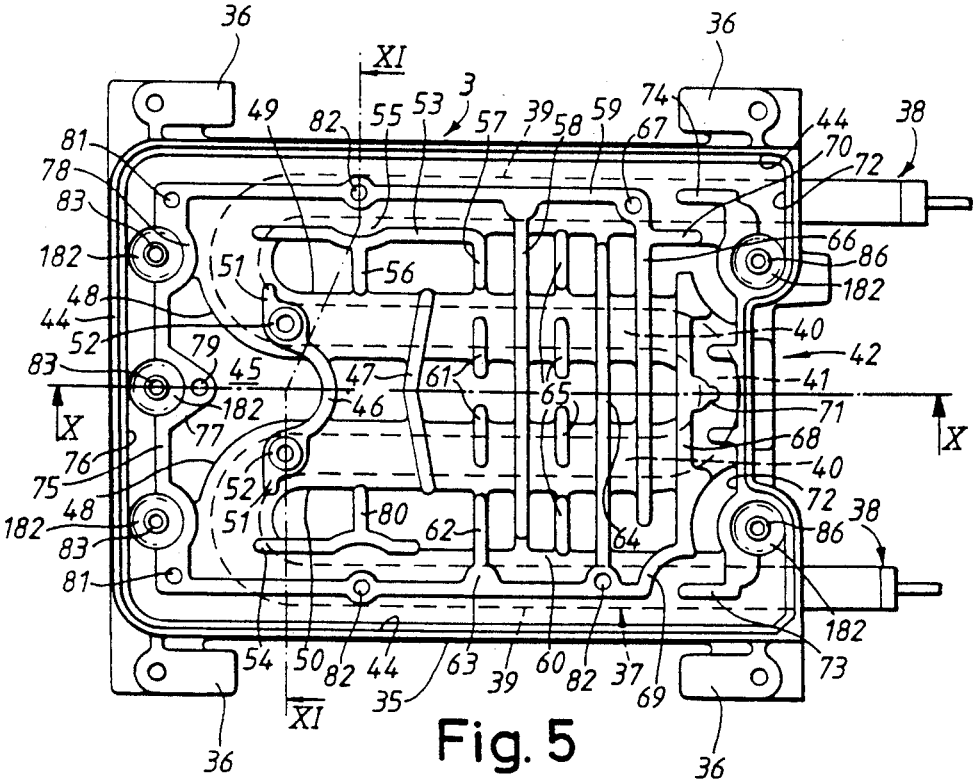
FIG. 5 is a plan view of a steam generator embodying the invention and included in the steamer shown in FIGS. 1 and 2, the generator cover plate having been removed.
Figure 6:
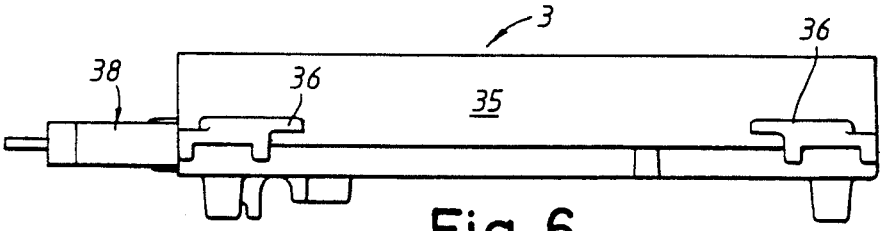
FIG. 6 is a side elevation of the steam generator shown in FIG. 5.
Figure 9:
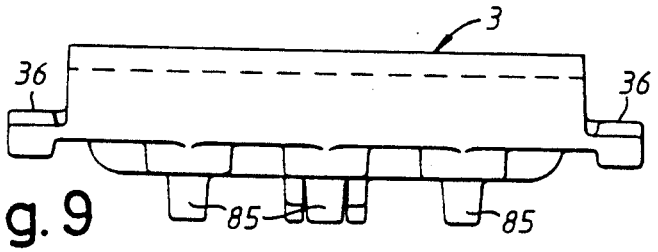

As can be seen from FIG. 5, the generator 3 is of generally rectangular form when viewed from above. The generator has a body 35 of a cast heat conductive metal alloy. Projecting from the side walls of the body 35 are mounting ears 36 apertured to receive mounting screws and by means of which the generator is mounted within the housing 1.

Cast integrally with the body 35 is an electric heating element 37 of the sheathed, resistance type. The element 37 is of generally W-shaped configuration with co-planar, spaced, parallel limbs and its ends extend from one end face of the body 35 as indicated at 38.

The contour of the element 37 is shown in dotted lines in FIGS. 5 and 7 and it will be observed that the outer parallel limbs 39 that are spaced from but lie parallel to the sides of the body 35 and are joined by semi-circular portions to the parallel inner limbs 40 which are each approximately equi-spaced from each other and from the outer limbs to which they are also parallel. The inner limbs are interconnected by a semi-circular portion 41 that is located adjacent an end face of the body 35.

That end face is recessed as indicated at 42 to receive a thermally responsive element 43 (FIG. 2).

The upper face of the body 35 is deeply recessed to form a chamber whose upper part is bounded by a wall 44. The base of the chamber has raised parts which enclose the limbs of the heating element 37 and which are referred to below, and a series of upstanding ribs cast integrally with the body 35 and the spaces between which form extended passageways from a water inlet chamber 45 to a series of steam outlets described below. Between the raised parts are formed deep channels.

The water inlet chamber 45 lies adjacent a semi-circular rib 46 and is bounded, in part, by the side walls 48 of raised parts 49, 50 of the body 35, each of which accommodates one of the inner limbs 40 of the heater element 37.

The rib 46 extends upwardly from the channel floor and over the raised parts 49, 50 and terminates at both ends in short linear extensions 51. Adjacent the extensions 51, the upper surface of the rib 46 has two bosses 52 each with a threaded bore closed at its inner end.

Spaced from the rib 46 is a V-shaped transverse rib 47 that also extends from the channel floor and over the raised parts 49, 50 towards short lateral ribs 53, 54 that lie parallel to the sides of the body 35.

Rib 53 bounds one part of the length of another raised part 55 which accommodates limb 39 of the heater element 37. Rib 53 also has a short central extension 56 that projects upwardly from the channel floor between parts 55 and 49. The junction of extension 56 with rib 53 is located centrally of a curved section of the rib as can be seen from FIG. 5. Rib 53 also has a right-angled end 57 that extends upwardly from the channel floor between raised parts 49 and 55. The end 57 lies approximately halfway between the extremity of rib 47 and a transverse rib 58. Rib 58 extends upwardly from the channel floor and from a lateral rib 59 that lies parallel to but spaced from the adjacent side of the body 35 and is located centrally of the raised part 55 from which it extends upwardly. As can be seen from FIGS. 5 and 10, rib 58 extends upwardly from the channel floor and passes across the raised parts 49, 50 and terminates just short of a raised part 60 that accommodates the lower (as seen in FIG. 5) outer limb 39 of the heater 37.

Also located about midway between ribs 47 and 58 are short spaced transverse ribs 61 which lie in line with end 57 of rib 53 and a short transverse rib 62 that, with ribs 61, extend upwardly from the channel floor and from a second lateral rib 63 that is parallel to but spaced from the adjacent side of the body 35 and lies centrally of raised part 60 from which it extends upwardly. As can be seen from FIG. 5, ribs 61 extend for a short distance into the deep channels between the raised parts enclosed limbs 40 of the heater 37.

Lying parallel to and spaced from transverse rib 58 is another transverse rib 64 that extends upwardly from the channel floor and joins lateral rib 63 at one end while the other end terminates just short of the raised part 55.

Lying centrally between and parallel to ribs 58 and 64 are short spaced transverse ribs 65, the outer ones of which extend upwardly from the channel floors, the inner ones extending upwardly from the raised parts 49 and 50 and extend for a short distance into the channel between these parts.

On the other side of rib 64 from ribs 65 is a further transverse rib 66 that extends upwardly from the channel floor and is joined at one end to an end of lateral rib 59. The junction between the two ribs is enlarged somewhat to accommodate a short stud 67 located centrally of the enlargement. Rib 66 extends across from part 55, across parts 49 and 50 and terminates just short of portion 60. Rib 66 lies parallel to rib 64 and is spaced therefrom by a distance substantially equal to that between ribs 64 and 65.

Lying parallel to rib 66 is another transverse rib 68 that extends upwardly from the channel floor and is a transverse continuation of lateral rib 63 being joined thereto by a curved rib section 69 as shown. Rib 68 extends across from part 60, across parts 50 and 49 and terminates a short distance from a short lateral rib 70 that projects from rib 66 adjacent the stud 67.

Rib 69 has a protruberance 71 that extends laterally midway of the length of the rib towards a transverse internal end face 72 having laterally extending end parts 73, 74 that are aligned, respectively, with the lateral ribs 59 and 63 but terminate a short distance from the adjacent ends thereof.

The other ends of the lateral ribs are joined by a transverse rib 75 that extends upwardly from the channel floor and is spaced from an internal end face 76 of the chamber in the body 35. The rib 75 has a laterally extending protruberance 77 and two sections 78 that curve inwardly towards the water chamber 45. Protruberance 77 carries a centrally located short stud 79.

Rib 54 lies generally parallel with lateral rib 63, bounds part of the length of the raised part 60 and has a short central extension 80 that extends upwardly from the channel floor and is aligned with extension 56 of rib 53. The junction between extension 80 with rib 54 is located centrally of a gently curved part of the latter as can be seen from FIG. 5.

At the junctions between the transverse rib 75 and the lateral ribs 59 and 63 are short studs 81.

Lateral ribs 59 and 63 also have thickened portions about midway of their ends which accommodate short studs bores 82 located centrally of the thickened portions.

Figure 10:
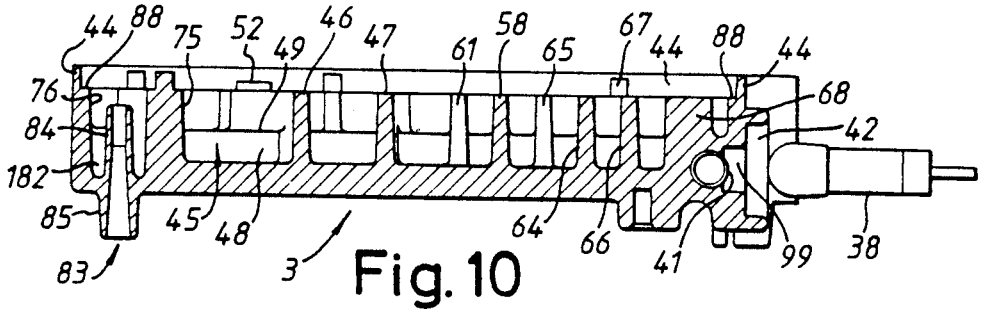
FIG. 10 is a section on the line VII—VII of FIG. 5.

Located in the channel between rib 75 and the adjacent side face 76 are three nozzles 83 cast integrally with the body 35 and which have an upward part 84 and a downward part 85 that projects from the base of the body 35 as seen in FIG. 10. The three nozzles are in line and the center nozzle lies on the longitudinal center line of the body 35, the other nozzles being equi-spaced from the central nozzle.

Each nozzle has a longitudinal bore which is of constant transverse cross-sectional area for a short distance and after which the cross-sectional area of the bore increases with increasing distance from the upper (as seen in FIG. 10) end of the bore.

Two further nozzles 86 are located at the other end of the body 35 from the other three nozzles. The nozzles 86 are identical in shape and size with the first three nozzles and are located in the channels between the end parts 73, 74 and the adjacent inner face 72.

The upward parts 84 of the nozzles seat in deep wells in the body 35 of the steam generator. The wells are shown in FIG. 5 and referenced 182. FIG. 10 also shows one well in section. As can be seen from FIG. 10, the bottoms of the well lie below the level of the floors of the channels.

Figure 12:
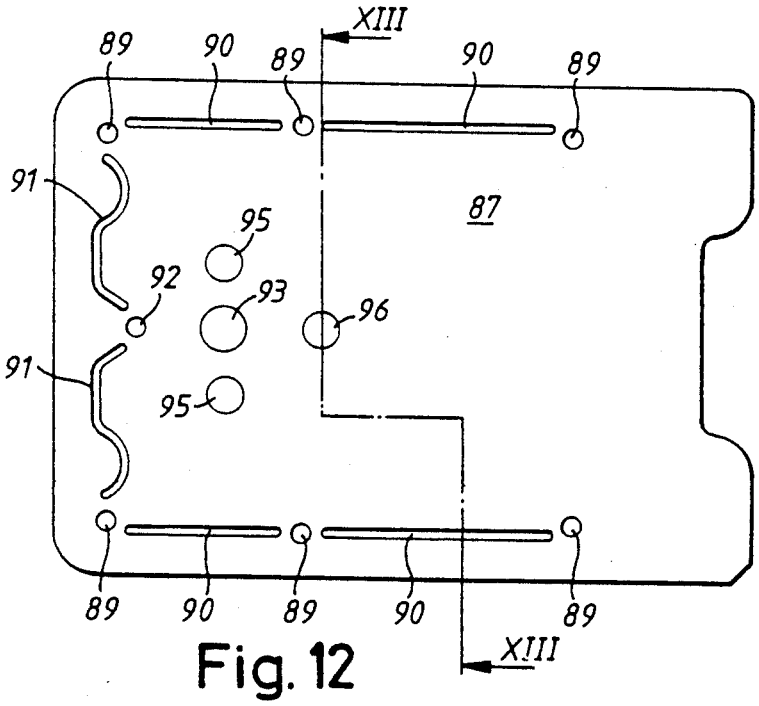
FIG. 12 is a plan view of the cover plate of the steam generator shown in FIG. 5.
Figure 13:
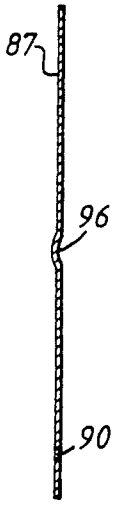
FIG. 13 is a section on the line XIII—XIII of FIG. 11.
Figure 11:
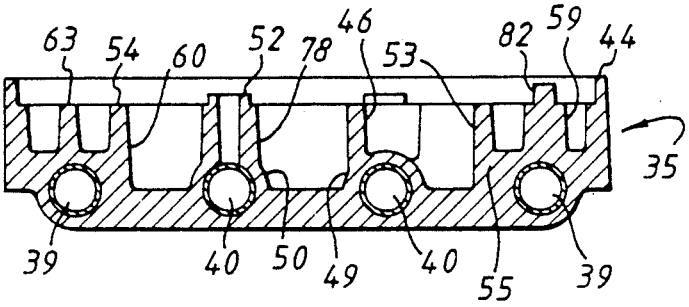
FIG. 11 is a section on the line XI—XI of FIG. 5.

The open upper (as seen in FIG. 10) face of a steam generator 3 is normally closed by a metal closure plate 87 shown in FIGS. 12 and 13. The closure plate 87 is sized to fit closely within the wall 44 and to seat on an internal ledge 88 that lies in the same plane as the upper edges of the fins referred to above.

Plate 87 has holes 89 located so as to align with the studs 81 and 82 when the plate is seated on ledge 88. Additionally, the plate 87 has lateral slots 90 which align with the upper parts of lateral ribs 59 and 63, and transverse slots 91 contoured to align with the upper parts of transverse rib 75. Between slots 91 is a hole 92 that aligns with the study 79 when the plate is seated upon ledge 88. A larger hole 93 gives access to the water chamber 45 from the outlet 94 of pump 7, the outlet seating in the hole when the components are assembled as shown in FIG. 2. On each side of hole 93 are further holes 95 that align with the bosses 52 when the plate 87 is seated upon ledge 88.

Plate 87 has a central small depression 96 which serves to facilitate separation of a stack of plates during assembly.

To close the open face of the steam generator 3, the plate 87 is seated upon the ledge 88 with the upper edges of lateral ribs 59 and 63 and of transverse rib 75 located respectively beneath slots 90 and 91. Holes 89 engage the studs referred to above. Screws are then passed through the holes 92 and 95 and screwed into the bores aligned with those holes. A suitable heat resistant sealant and adhesive is then poured into slots 90 and 91 and allowed to set.

After the cover plate 87 has been secured in position, the thermally responsive element 43 is secured in the recess 42 of the steam generator 3 by means of screws which pass into screw holes 98 in that end face of the body 35 shown in FIG. 8. It will be observed from FIGS. 8 and 10 that there is a small opening 99 located centrally of the inner wall of the recess 42 and that a part of the semi-circular portion 41 of the heating element 37 is exposed through the opening 99.

The steam generator 3 is located between the clam shells by ribs referred to above and which extend inwardly from the internal faces of the clam shells.

Figure 4:
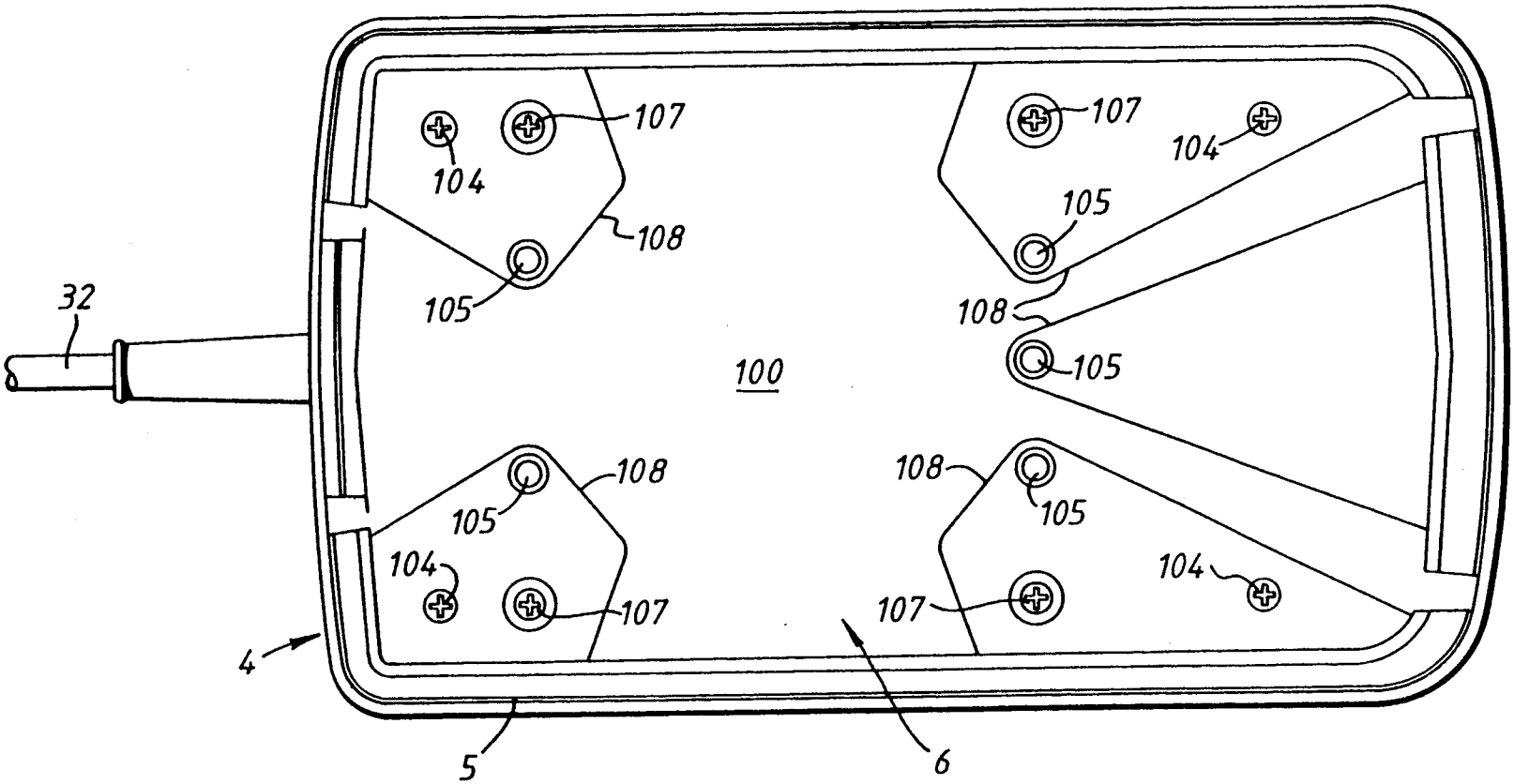
FIG. 4 is an underneath view of the steamer.

As can be seen from FIG. 4, the base portion 4 is generally of the construction described in the Application referred to above and has a floor 100 with a number of spaced lateral strengthening ribs (not shown) on its upper surface. In addition, there is a first series of spaced bosses that extend upwardly from the upper surface at locations aligned with the apertures in the mounting ears 36 of the steam generator 3 and by means of which the steam generator 3 is secured in position be screws 107 which pass through the bosses and into the holes in the ears. Two of the bosses are shown in FIG. 2 and are referenced 101.

Further bosses 103 positioned adjacent the corners of the floor 100 and extending upwardly from the upper surfaces thereof allow the base portion 4 to be fixed to the clam shells by means of screws 104 which pass upwardly through the further bosses and into bores in respective bosses on the inner faces of the clam shell halves.

Each of the nozzles 83, 86 of the steam generator has a steam exit nozzle 105 that projects upwardly from the upper surface of the floor 100. The steam outlet nozzles are joined to the lower parts 85 of the outlet nozzles 83 by short lengths of gasket 106 which also serve to insulate the floor 100 thermally from the nozzles 83.

FIG. 4 is an underneath view of the steamer and it can be seen that the lower face of the floor 100 has several approximately wedge-shaped areas 108 that are slightly recessed with respect to the remainder of the lower face and that each of the outlets 105 is located in a corner of one of the areas 108. The recessed areas tend to assist the distribution of steam throughout the steam chamber.

Before use, the water tank 2 is filled with water and positioned on the housing 1. The power cable 32 is also connected to a suitable power source. On connection, the heating element 37 is energised and the neon lamp 34 glows. The user then allows a short time for the steam generator to reach its working temperature and rocker arm 9 is then activated to an 'on' position upon which the switch 8 permits energisation of the pump 7. The pump 7 then pumps water from the tank 2 into the inlet chamber 45 when the water is flashed into steam. The generated steam leaves the steam chamber and enters the passageways lying between ribs 53 and 59, ribs 54 and 63, ribs 46 and 53, 54. Those passageways join in the space between ribs 47 and 58. From that space, the steam flows into the space between ribs 58 and 64, then round rib 66 and into the space between ribs 66 and 68. Steam exits from that space, firstly, via the passage between short rib 70 and end part 74 into the passage between the side walls of the chamber and immediately adjacent lateral rib 59. That passage joins the transverse passage between side wall 76 and transverse rib 75 and gives access to the steam outlet nozzles 83.

Secondly, steam exits from that space into a space between transverse rib 68 and internal end face 72 and leaves via the passageway between end parts 74 and the adjacent curved rib section 69 into a passageway between the other side wall of the chamber and immediately adjacent transverse rib 63. That passageway joins the transverse passageway along the side wall 76 referred to above. Thus the steam nozzles 83 are supplied with steam via the other end of that transverse passageway.

Steam also flows to the steam outlet nozzles 86 from the passageway between the side wall of the chamber and the lateral ribs 59 and 63.

From the nozzles 83 and 86, the steam passes into the steam chamber 6 via the outlet nozzles in the floor 100 of the base 4.

At this stage, the base portion is placed against an area of wallpaper to be stripped, the edge of the peripheral wall 5 contacting the wallpaper. Steam confined in the steam chamber permeates through the wallpaper and rapidly softens the adhesive securing the wallpaper to the wall.

The steam chamber is configured to provide a largo heat transfer surface for conveying heat from the body 35 of the generator to the water and to steam generated therefrom. The extended passageways between the inlet chamber and the steam outlet nozzles also help to ensure that all the water entering the inlet chamber is converted into steam before it reaches the outlet nozzles.

The use of the raised parts round the limbs of the heating element serve to provide extra heat exchange surfaces and they also reduce the overall depth of the steam generator.

As can be seen from FIG. 7, the W configuration of the heating element 37 ensures an even distribution of heat over the entirety of the body 35, and that the body reaches its working temperature quickly. The 'folded' configuration of the heating element means that heat therefrom passes into the body over a greater area of the latter than would otherwise be possible. Heat transfer is also facilitated by the extended heat transfer surfaces provided by the ribs.

The water inlet chamber 45 is located in an area between the curved parts of the element where the heat output from the heating element is somewhat less intense than in other areas and this reduces the build-up of scale in the inlet chamber. Any particles of scale or other sediment that form in the inlet chamber tend to remain there because the chamber is bounded by rib 75, faces 48 of the curved portions and the rib 46.

The channels formed between the raised parts 49, 55, 49 and 50 and 60 are divided into pockets which form further collecting areas for scale particles and other sediment.

In the event that scale particles or other sediment reach the vicinity of the nozzle 83, the particles and sediment tend to accumulate in the deep well surrounding the nozzles and do not enter the latter and the possibility of blockage thereof is considerably reduced.

Thermostat 43 is located in an area of the generator close to the heating element and where it experiences intense heat therefrom. This ensures a rapid response from the thermostat to changes in temperature. In addition, a thermal safety fuse is also located in the same area for the same reason.

As will be inferred from the foregoing, the wallpaper steamer, when used to steam paper on a vertical wall, is used in an orientation in which the water tank 2 is uppermost. In that orientation, the generator 3 lies in a vertical plane with the inlet chamber 45 uppermost. Although this might result in some accumulation of water in the steam chamber 45, such accumulation is slight because any excess water tends to spill over the linear extensions 51 into the deep pockets formed between the raised parts 49, 55, and 50, 60 where the water is rapidly flashed into steam.

It is possible for the orientation of the steam generator to be changed so that when the steam is used on a vertical wall, the inlet chamber 45 is lowermost.

Figure 14:
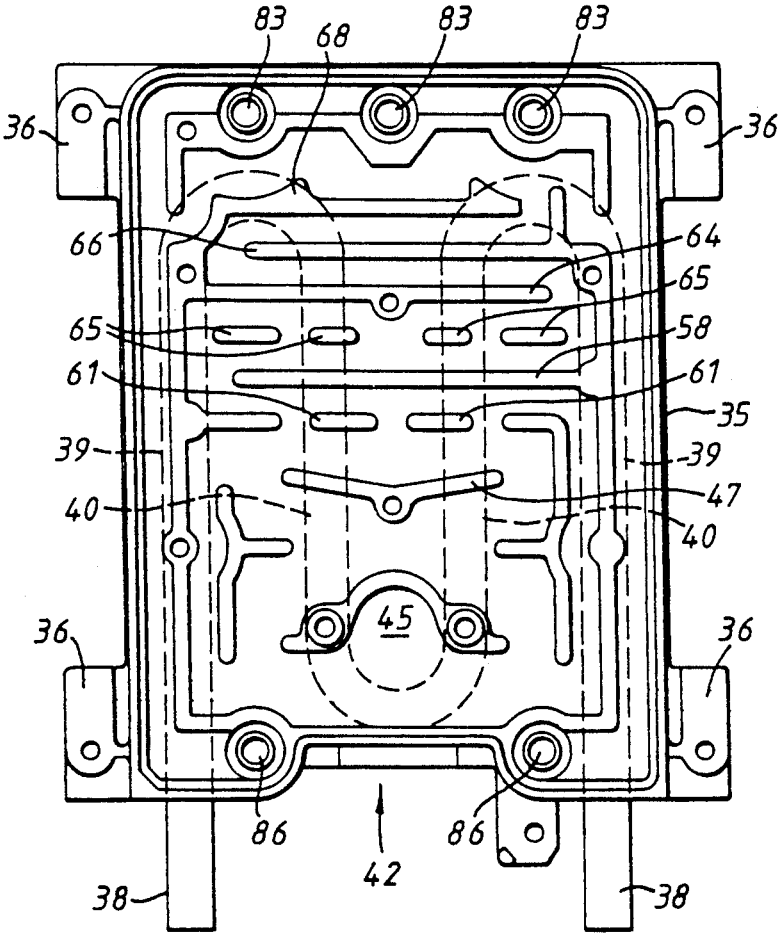
FIG. 14 is a plan view of an alternative form of steam generator embodying the invention, the generator cover having been removed.

Another form of the steam chamber is shown in FIG. 14 from which it will be observed that the inlet chamber 45 is now located adjacent the semi-circular portion 41 of the heating element 37. The ribs of the FIG. 14 embodiment occupy the same positions relative to the inlet chamber 45 as in the embodiment described above with reference to FIG. 5 but they are turned through 180° relatively to the nozzles 83 and 86.

In the embodiment of FIG. 14, flashing of the water into steam occurs almost exclusively in the inlet chamber 45 and in its immediate vicinity. The risk of entrainment in the steam of particles of steam or other materials is somewhat reduced as compared with the embodiment of FIG. 5. However, any particles that are entrained are deposited in one or other of the deep pockets or in the wells that surround the steam outlet nozzles.

The size, weight and balance of the wallpaper steamer are such that it can be comfortably hand-held and used over relatively long periods without strain. To achieve that the capacity of water tank 2 is limited. That capacity in conjunction with the pumping rate of pump 7 determines the maximum heat input provided by the element 37 that will ensure a reasonable period of use before the tank 2 has to be refilled.

It is found that a tank capacity of about 450 cc provides a manageable weight. Since a user may wish to use the steamer continuously once the tank has been filled, the pumping rate and the rate of steam generation must be selected to provide a reasonable running time before the tank has to be refilled and in practice it is to hand that a reasonable continuous running time is about 15 minutes. This requires a pumping rate of about 30 cc per minute and therefore the steam generator must be capable of converting that rate of flow of water into steam.

Suitably, the body 35 is about 127 mm long by 87 mm wide by 23 mm in thickness. At 240 volts, the heating element 37 is rated at 1200 Watts. The inlets of the nozzles 83, 86 are about 12.5 mm above the floor of the chamber.

Although the wallpaper steamer is normally used in an orientation in which the water tank is uppermost, it may be used in other orientations and will still operate effectively. For example, it may be used on a vertical wall in a horizontal orientation i.e. with the steam generator orientated as shown in FIG. 5 with the section line VII—VII horizontal. Water which is not flashed into steam in the chamber 45 will flow downwardly into contact with one or other of the lateral ribs 59 or 63 which are in good thermal contact with the raised parts 60, 55 respectively and the water is rapidly flashed into steam thereby.

The wallpaper steamer may also be used with the steam chamber 4 uppermost. Water entering chamber 45 may then impinge on the metal closure plate 87 which is in good thermal contact with the ribs and the body 35. Even in this orientation water is quickly turned into steam which is heated and dried as it flows towards the outlet nozzles 83, 86.

It will be appreciated that the steam generator can be used in other tools than wallpaper strippers. It can be incorporated, for example, in steam irons, in hand-held steamers for removing creases from garments, soft furnishing etc.

The above described embodiments, of course, are not to be construed as limiting the breadth of the present invention. Modifications, and other alternative constructions, will be apparent which are within the spirit and scope of the invention as defined in the appended claims.

We claim:

1. A steam generator, comprising:

a body of heat conductive material, the body being recessed to form a chamber;

an electric heating element located within the chamber and having a series of spaced, parallel limbs embedded in spaced, raised parts of the floor of the chamber to form channels between adjacent raised parts;

barriers dividing up some at least of the channels into separate sections and allowing communication between the sections via passages which pass over the raised parts;

a water inlet chamber located between the adjacent raised parts and in communication with the passages;

a plurality of steam outlets also in communication with the passages;

the steam outlets being nozzles whose entrances are located above the floor of the chamber;

the body being recessed at one end to form a recess and a thermally responsive element being located in the recess; and the recess having an inner wall with an opening through which is exposed a part of the heating element.

2. A steam generator as claimed in claim 1, in which the chamber has a peripheral wall with a stepped edge on which seats a closure plate that closes the chamber and which is apertured to permit entry of water into the water inlet chamber.

3. A steam generator as claimed in claim 2, in which the heating element has outer parallel limbs between which are located two other limbs that are parallel to the outer limbs and to each other, adjacent limbs having ends that are joined by curved sections of the heating element.

4. A steam generator as claimed in claim 1 in which some of the barriers have gaps which allow communication between adjacent separate sections.

5. A steam generator as claimed in any one of claim 1, in which the water inlet chamber is defined in part by a barrier of curved shape when seen in plan.

6. A steam generator as claimed in claim 1, in which there are first and second lateral barriers, each lateral barrier lying adjacent a respective side wall of the chamber and being spaced therefrom to define lateral passageways in communication with the sections and with the steam outlets.

7. A steam generator as claimed in claim 6 in which the lateral barriers are positioned on respective raised parts.

8. A steam generator as claimed in claim 7 in which the lateral passageways communicate, in an area adjacent the other end of the chamber, with a channel lying centrally of the sides of the chamber.

9. A steam generator, comprising:

a body of heat conductive material, the body being recessed to form a chamber;

an electric heating element located within the chamber and having a series of spaced, parallel limbs embedded in spaced, raised parts of the floor of the chamber to form channels between adjacent raised parts;

barriers which divide up some at least of the channels into separate sections and which allow communication between the sections via passages which pass over the raised parts;

a water inlet chamber located between the adjacent raised parts and in communication with the passages;

a plurality of steam outlets also in communication with the passages;

said steam outlets being nozzles whose entrances are located above the floor of the chamber;

some of the barriers having gaps which allow communication between adjacent separate sections;

the water inlet chamber being defined in part by a barrier of curved shape when seen in plane;

the steam outlets being in two groups, of which one group is located adjacent one end of the chamber and the other group is located adjacent the other end of the chamber;

first and second lateral barriers, each lateral barrier lying adjacent a respective side wall of the chamber and being spaced therefrom to define lateral passageways in communication with the sections and with the steam outlets;

the lateral barriers being positioned on said raised parts;

the lateral passageways communicating, in an area adjacent the other end of the chamber, with a channel lying centrally of the sides of the chamber; and further lateral barriers lying adjacent respective ones of the first and second lateral barriers and positioned to define further lateral passageways extending from the water inlet chamber.

10. A steam generator as claimed in claim 9, in which the body is recessed at one end and in which a thermally responsive element is located in the recess.

11. A steam generator, comprising:

a body of heat conductive material, the body being recessed to form a chamber;

an electric heating element located within the chamber and having a series of spaced, parallel limbs embedded in spaced, raised parts of the floor of the chamber to form channels between adjacent raised parts;

barriers which divide up some at least of the channels into separate sections and which allow communication between the sections via passages which pass over the raised parts;

a water inlet chamber located between the adjacent raised parts and in communication with the passages;

a plurality of steam outlets also in communication with the passages;

the steam outlets comprising nozzles whose entrances are located above the floor of the chamber;

some of the barriers having gaps which allow communication between adjacent separate sections;

first and second lateral barriers, each lateral barrier lying adjacent a respective side wall of the chamber and being spaced therefrom t define lateral passageways in communication with the sections and with the steam outlets;

the heating element having outer parallel limbs between which are located two other limbs that are parallel to the outer limbs and to each other, adjacent limbs having ends that are joined by curved sections of the heating element; and the water inlet chamber being located in an area bounded in part by curved sections of the heating element and in part by a barrier of curved shape when seen in plane.

12. A steam generator as claimed in claim 11, in which the steam outlets are in two groups, of which one group is located adjacent one end of the chamber, and the other group is located adjacent the other end of the chamber.

13. A steam generator, comprising:

a body of heat conductive material of rectangular form when seen in plan;

an electrical heating element housed within the body, the element having a series f spaced, parallel copolymer limbs which lie parallel to the sides of the body and are spaced across the body, the ends of the element projecting from one end of the body;

adjacent limbs within the body being interconnected by curved portions, the limbs and the curved portions being enclosed within the material in a manner such that channels are formed between adjacent limbs, the channels having bottoms located at a certain level int eh body;

a water inlet chamber formed in the body centrally of the sides thereof and adjacent the curved portions interconnecting immediately adjacent limbs;

a series of barriers spaced along the lengths of the limbs and extending transversely thereof, and further lateral barriers lying parallel to the sides of the body, the barriers providing, with the channels, extended passageways leading from the inlet chamber to each of a series of steam outlet nozzles in the body; and each nozzle being located within a well formed in the body, each well fully surrounding its respective nozzle with the bottom of each well lying below said level of the channel bottoms.

14. A steam generator, comprising:

a body of heat conductive material recessed on an upper side to form a chamber having a floor at a specific level in the body;

an electric heating element embedded in the body;

said chamber comprising a water inlet chamber in communication with a steam chamber;

said steam chamber being subdivided by a plurality of barriers into passages for passage of steam from said water inlet chamber to a plurality of steam outlet nozzles;

said steam outlet nozzles passing downwardly through said floor and having inlet portions extending upwardly into said chamber above aid floor; and each said inlet portion being surrounded by a well recessed in said floor, said well having a bottom below said specific level of said floor.

15. The steam generator of claim 14, wherein at least two said passages communicate with and extend from said water inlet chamber, and said barriers cause said at least two said passages to combine into a single passage before communicating with said steam outlet nozzles.

16. The steam generator of claim 14, wherein at least some of said barriers have a plurality of gaps therethrough for passage of steam and others of said barriers have only one gap therethrough for passage of steam.

17. The steam generator of claim 16, wherein said at least some of said barriers and said others of said barriers are parallel and spaced apart to form at least some of said passages therebetween.

18. The steam generator of claim 17, wherein said electric heating element comprises four parallel spaced apart limbs extending parallel to the lengthwise direction of said body with adjacent limbs connected by curved and portions, and said parallel barriers extend transversely across said limbs.

19. The steam generator of claim 18, wherein said limbs are embedded in said floor with raised portions of said floor covering upper surfaces of said limbs, at least some of said raised portions traversing said parallel barriers to define pockets in aid passages for collecting scale particles and sediment produced during generation of steam.

20. The steam generator of claim 14, wherein said electric heating element comprises four parallel limbs connected together in a W configuration, some of said barriers extend at right angles to said limbs, and pockets for collecting scale particles and sediment are defined in said passages by intersection of said limbs with said some of said barriers.

21. A steam generator, comprising:

a body having a recessed chamber formed therein;

a plurality of steam outlet nozzles each communicating at an upper end with said recessed chamber and at a lower and exteriorly of said body;

means for heating said body and effecting steam generating from water in said recessed chamber;

a plurality of partitions subdividing said recessed chamber into a water inlet chamber and a plurality of steam passages which distribute steam from said water inlet chamber to the upper ends of said nozzles;

said water inlet chamber communicating with four of said steam passages to provide four separate passages for steam from said water inlet chamber, these four steam passages then combining into a single steam passage before separating again into at least two steam passages; and said at least two steam passages subsequently combining into a single steam passage again before again dividing into at least two steam passages leading to said steam outlet nozzles.

22. The steam generator of claim 21, wherein at least some of said steam passages have pockets formed therein for collecting scale particles and sediment formed by said steam generation.

23. The steam generator of claim 21, wherein a recessed well is located between each said steam outlet nozzle and any passage distributing steam thereto in order to trap in said well any scale particles and sediment reaching the respective steam outlet nozzle.

24. The steam generator of claim 21, wherein said recessed chamber has opposite side walls joined by opposite walls, and said steam outlet nozzles are located adjacent said end walls with no steam outlet nozzles located along said side walls.

25. The steam generator of claim 24, wherein said water inlet chamber is disposed adjacent one of said end walls with one of said partitions between said water inlet chamber and those of said steam outlet nozzles adjacent said one of aid end walls.

26. The steam generator of claim 25, wherein some of said partitions are spaced-apart and parallel to said one of said partitions, said spaced-apart parallel partitions having gaps therein, alternate ones of said spaced-apart parallel partitions having only one gap for passage of steam while the others of these spaced-apart parallel partitions each having at least three spaced-apart gaps therein for the passage of steam therethrough.

27. The steam generator of claim 21, wherein said recessed chamber has a bottom floor, and each of said steam outlet nozzles has a well therearound which is recessed below said bottom floor to trap and collect scale particles and sediment therein.

28. A steam generator, comprising:

a body of heat conductive material, the body having a top surface and a bottom surface and being recessed inwards from the top surface to form az chamber;

an electric heating element located within the chamber and having a series of spaced, parallel limbs embedded in spaced, raised parts of a floor of the chamber to form channels between adjacent raised parts;

barriers which divide up some at least of the channels into separate sections and which allow communication between the sections via passages which pass over the raised parts;

a water inlet compartment located in said chamber between two of the adjacent raised parts and in communication with the passages;

a plurality of steam outlets also in communication with the passages, the steam outlets being nozzles whose entrances are located above the floor of the chamber and whose exits are located below said bottom surface;

some of the barriers having gaps which allow communication between adjacent separate sections;

the water inlet compartment being defined in part by a barrier of curved shape when seen in plan;

the steam outlets being in two groups, of which one group is located adjacent one end of the chamber, and the other group is located adjacent the other end of the chamber;

first and second lateral barriers, each lateral barrier lying adjacent a respective side wall of the chamber and being spaced therefrom to define lateral passageways in communication with the sections and with the steam outlets, the lateral barriers being positioned on respective raised parts;

the lateral passageways communicating, in an area adjacent the other end of the chamber, with a channel lying centrally of the sides of the chamber;

further lateral barriers lying adjacent respective ones of the first and second lateral barriers and positioned to define further lateral passageways extending from the water inlet compartment;

the body being recessed at one end with a thermally responsive element located in the recess, the recess having an inner wall with an opening through which is exposed a part of the heating element;

the chamber having a peripheral wall with a stepped edge on which seats a closure plate that closes the chamber and which is apertured to permit entry of water into the water inlet compartment;

the heating element having outer parallel limbs between which are located two other limbs that are parallel to the outer limbs and to each other, adjacent limbs having ends that are joined by curved sections of the heating element; and the water inlet compartment being located in an area bounded in part by at least one curved section of the heating element.

29. The steam generator of claim 28, wherein said nozzles are surrounded by wells which are recessed in and below said chamber floro.

30. The steam generator of claim 29, wherein said water inlet compartment is located adjacent said one end of the chamber and has two oppositely disposed outlets which communicate with said passages at opposite ends of said barrier of curved shape.

* * * * *